US005083316A

United States Patent [19]

Kuehner

[11] Patent Number: 5,083,316

[45] Date of Patent: Jan. 28, 1992

[54] GARMET STRUCTURE

[76] Inventor: Ellen M. Kuehner, 174 Park St., Montclair, N.J. 07042

[21] Appl. No.: 524,881

[22] Filed: May 18, 1990

[51] Int. Cl.[5] ..... A41D 7/00

[52] U.S. Cl. ..... 2/67; 2/69; 2/70; 2/243 R

[58] Field of Search ..... 2/67, 70, 119, DIG. 2, 2/DIG. 1, 408, 402, 243 B, 265, 400, 69, 243 R

[56] References Cited

U.S. PATENT DOCUMENTS

| | | | |
|---|---|---|---|
| 1,489,046 | 4/1984 | Thompson | 2/70 |
| 1,986,792 | 1/1935 | Calvo | 2/67 |
| 2,166,154 | 7/1939 | Zapis | 2/67 |
| 2,292,227 | 8/1942 | Kopyto | 2/67 |
| 2,493,531 | 1/1950 | Fitches | 2/115 |
| 2,722,686 | 11/1955 | Hosking | 2/DIG. 2 |
| 3,023,419 | 3/1962 | Strahle | 2/67 |
| 4,103,360 | 8/1978 | Belpaune | 2/67 |
| 4,683,595 | 8/1987 | Cash | 2/221 |
| 4,815,145 | 3/1989 | Chow | 2/67 |
| 4,951,321 | 8/1990 | Mortensen et al. | 2/408 |
| 4,961,234 | 10/1990 | Leibman | 2/408 |

FOREIGN PATENT DOCUMENTS

| | | | |
|---|---|---|---|
| 208956 | 4/1909 | Fed. Rep. of Germany | 2/408 |
| 1408827 | 7/1964 | France . | |
| 1540344 | 3/1967 | France | 2/70 |
| 2535177 | 5/1984 | France | 2/DIG. 2 |
| 2192529 | 1/1988 | United Kingdom | 2/69 |

*Primary Examiner*—Werner H. Schroeder
*Assistant Examiner*—Amy Brooke Varatta
*Attorney, Agent, or Firm*—Melvin K. Silverman

[57] ABSTRACT

A garment system for the full or partial enclosure of the torso, preferably in the form of a ladies bathing suit. The garment system includes a first central portion which constitutes a first ornamental region. The central portion is formed of front and rear body panels, the extents of which are defined by lateral perimeters. The lateral perimeters include first cooperative fastening elements, which perimeters define the geometry of the first ornamental region. Further provided are left and right portions proportioned to encircle the left and right sides of the torso. The left and right portions constitute second and third ornamental regions, which regions are defined by lateral perimeters, which perimeters include second cooperative fastening elements complemental to the first cooperative fastening elements of the central portion. Yet further provided is a second central portion, co-extensive in shape and perimeter with the first central portion and having like perimetric cooperative fastening elements to those of a first central portion. The second central portion constitutes a fourth ornamental region which may be selectably interchanged through the selective use of the first and second cooperative fastening elements, with the first ornamental region of the first central portion, thusly effecting a different appearance of the garment through the interchangeability of different central portions. In the alternative, different left and right portions may be interchanged. Additionally, the area of the crotch of the central portion may be selectably opened, precluding the need to entirely remove the garment.

11 Claims, 5 Drawing Sheets

GARMET STRUCTURE

BACKGROUND OF THE INVENTION

The present invention relates to a garment system for the full or partial enclosure of the torso. More particularly, the present garment system relates to a garment structure in the nature of a ladies bathing suit, a leotard, jump suit, or an undergarment having interchangeable panels for the purpose of altering the ornamental appearance of the crotch area of the garment to permit bodily function to occur without need or requirement to remove the entire garment.

Ladies bathing suits having removable portions have been known in the art and are reflected in such prior art as U.S. Pat. No. 1,954,526 (1934) to Holahan, entitled Bathing Outfit; and U.S. Pat. No. 1,986,792 (1935) to Calvo, entitled Bathing Suit. Structures of this type provide for the removability of a portion of the bathing suit without necessarily removing the entire garment from the body of the user. However, neither of these garments, or other art known to the inventor, has integrated that removability function with the function of interchangeability in order to provide differing ornamental effects and definitions within the particular garment system.

In the area of men's bathing suits, U.S. Pat. No. 2,292,227 (1942) to Kopyto, entitled Slide Fastener Arrangement for Bathing Suits, teaches the use of a center portion which may be removed by the user after bathing when a pair of trousers have been donned. After removal of the center portion, the left and right side portion of the bathing suit structure of Kopyto will also be removable. Kopyto does not structure his removal panels in terms that would make them interchangeable with other like panels having different ornamental definitions. Also, the structure of Kopyto does not permit continued use of the garment after the center panel has been removed for any reason.

In the area of briefs and panties, the prior art teaches the use of a selectably removable tab in the area of the crotch between a front and rear panel of the brief which, when used, permits an opening of the crotch area so that bodily functions may be effected without need to remove the brief or panty. This teaching appears in the U.S. Pat. No. 4,675,918 (1987) to O'Brien, entitled One Piece Brief With Hook and Pile Closures.

The invention makes use of the teachings of O'Brien and Kopyto and, thereto, adds the concept of utilizing removable panels to effect ornamental definitions and changes in the overall appearance of the particular garment structure, whether such structure be that of a ladies swim suit, a leotard, or more generalized garments such as tops, skirts or coordinated separates.

The novel structure of the present garment system also may provide contour support of selected areas of the anatomy, such as the waist and bust.

SUMMARY OF THE INVENTION

The invention constitutes a garment system for the full or partial enclosure of the torso, more particularly, including a first central portion comprising a first ornamental region and, further, including front and rear body panels which are defined by lateral perimeters, said perimeters also defining the geometry of said first ornamental region. The inventive garment system also includes left and right portions encircling at least a part of the left and right sides of the torso respectively, said left and right portions comprising second and third ornamental regions respectively and, further, defining lateral perimeters including second cooperative fastening elements complemental to said first cooperative fastening elements of said central portion, said lateral perimeters of each of said left and right portions defining the geometry of respective second and third ornamental regions. The present garment structure also includes a second central portion, co-extensive in shape and perimeter with said first central portion and having like perimetric cooperative fastening elements to those of said first central portion, said second central portion comprising a fourth ornamental region selectably interchangeable, through the selective use of said cooperative fastening elements, with said first ornamental region of said first portion, to thereby effect a different appearance of the garment resultant of the inventive garment system. The area of the crotch of the garment system may be opened through the use of said complemental first and second cooperative fastening elements at said lateral perimeters thereof to thereby facilitate bodily functions without need to entirely remove the garment resulting from the present garment system.

In an alternate embodiment, new left and/or right portions may be interchanged with the original left and right portions, thereby changing the ornamental appearance of the left and/or right portions of the garment system while keeping the first central portion without change therein.

It is accordingly an object of the present invention to provide a garment system having interchangeable ornamental panels therein.

It is another object of the present invention to provide a garment system of the above type in which a garment resultant thereof may be opened at the crotch area to facilitate bodily functions without need to entirely remove the garment.

It is a further object of the present invention to provide a garment system of the above type in which various different ornamental effects may be achieved from alternately interchangeable fabric components.

The above and yet other objects and advantages of the present invention will become apparent from the hereinafter set forth Detailed Description of the Invention, the Drawings, and claims appended herewith.

DETAILED DESCRIPTION OF THE INVENTION

Figure 2:
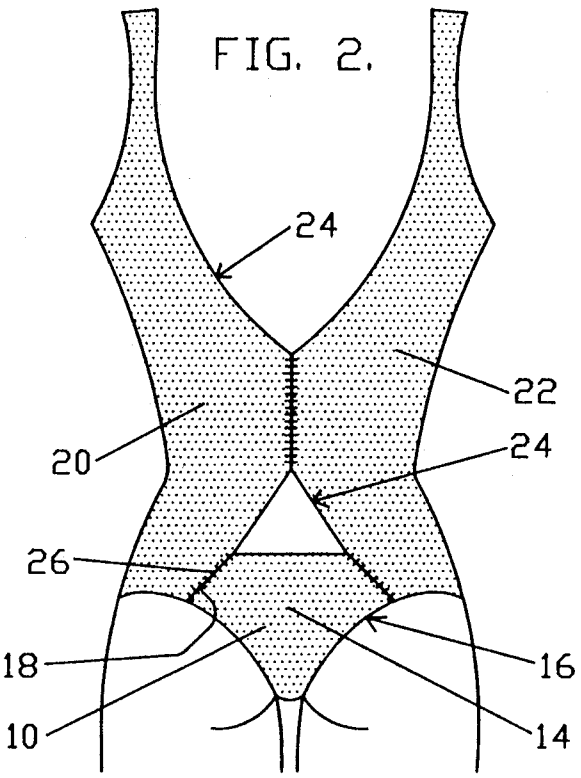
FIG. 2 is a rear perspective view of the embodiment of FIG. 1.
Figure 1:
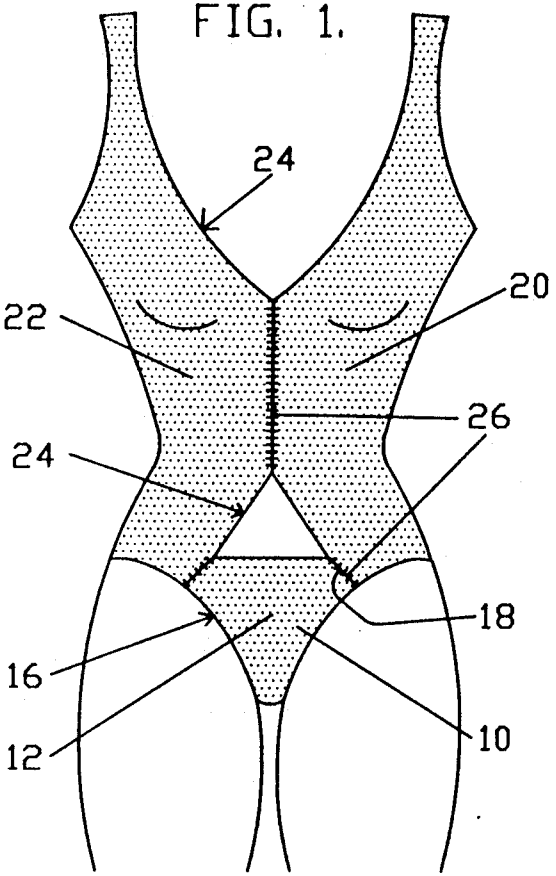
FIG. 1 is a front perspective view of a first embodiment of the present invention.
Figure 5:
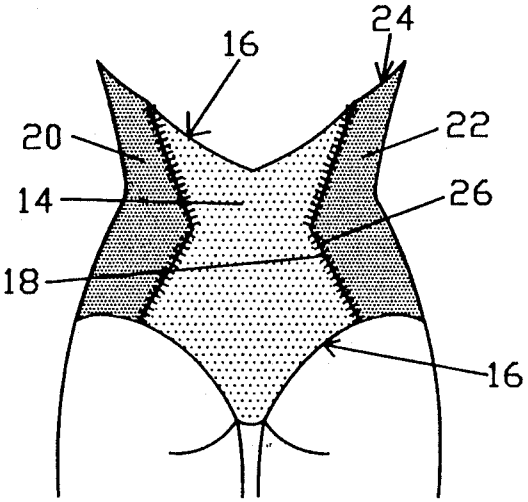
FIG. 5 is a rear perspective view of the embodiment of FIG. 4.
Figure 4:
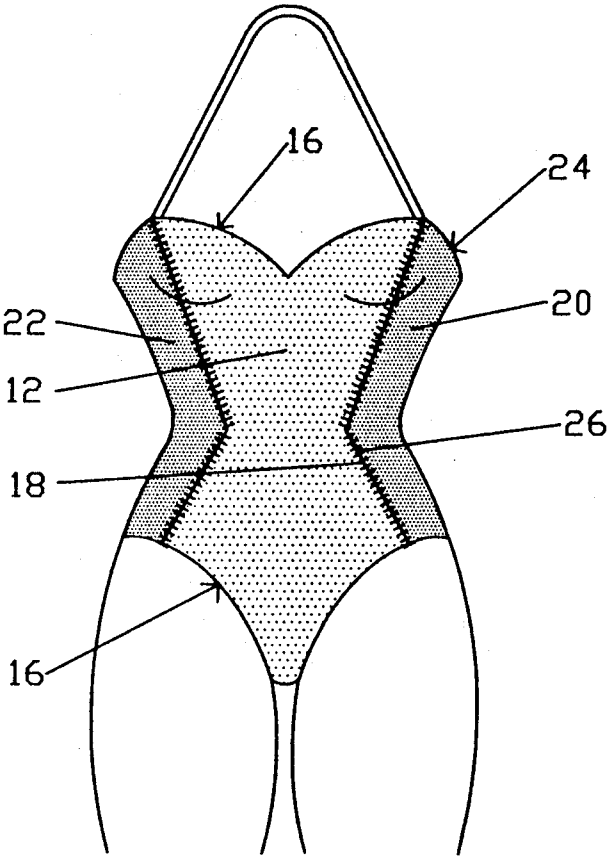
FIG. 4 is a front perspective view of a second embodiment of the present invention.

With reference to the front perspective view of FIGS. 1 and 4, and the rear perspective views of FIGS. 2 and 5, the present inventive garment system is seen to include a first central portion 10 which comprises a first ornamental region which, in a given embodiment, may constitute a solid color, mixed colors, or any particular graphic or artistic material. The first ornamental region of central portion 10 comprises a front body panel 12 (see FIGS. 1 and 4) and a rear body panel 14 (see FIGS. 2 and 5). The extent of said panels 12 and 14 are defined by lateral perimeters 16 (see also FIGS. 9 through 12) which include first cooperative fastening elements 18. Said lateral perimeters define the geometry of said first central portion 10 and, thereby, of said first ornamental region 10.

As may be noted in the views of FIGS. 9 through 12 said cooperative fastening element 18 may include any one of a number of fastening elements, including, but not limited to, eye-and-button means, buckle-means, hook-and-pile means, commonly known as "VELCRO", zipper means and hook-and-eye means.

With further reference to FIGS. 1, 2, 4 and 5, there is shown left portions 20 and right portions 22 of the garment system, each of which encircle at least a part of the respective left and right sides of the torso of the user. Said left portion may thereby be seen to comprise a second ornamental region and said right portion to comprise a third ornamental region. The geometric extent of said left and right portions and their corresponding second and third ornamental regions are defined by perimeters 24 thereof. Said perimeters 24 include second cooperative fastening elements 26 (see also FIGS. 9 through 12) which are complemental to said first cooperative fastening elements 18 of said central portion 10. Accordingly, central portion 10 may be readily fastened or unfastened from either or both left and right portions 20 and 22 through the use of said first and second cooperative fastening elements 18 and 26 respectively.

Figure 3:
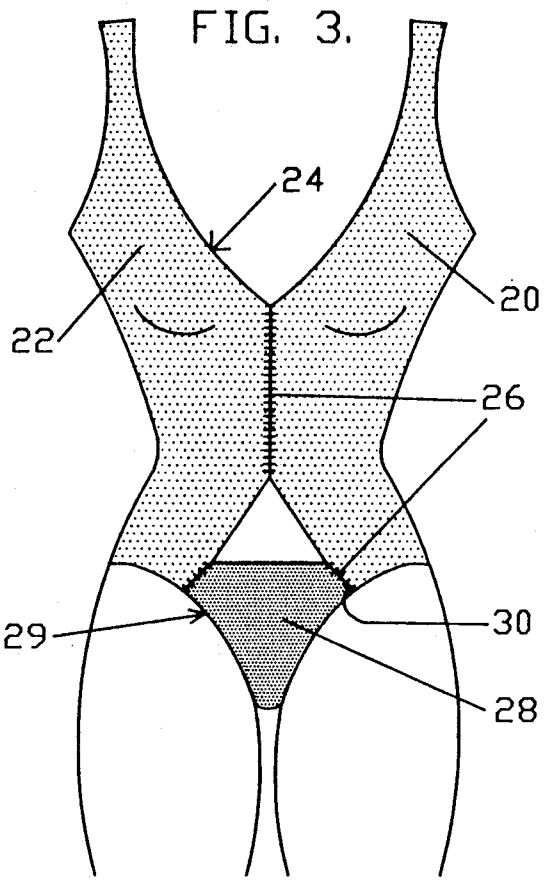
FIG. 3 is a perspective view of the embodiment of FIG. 1 showing the use of an alternate central portion of the garment.
Figure 6:
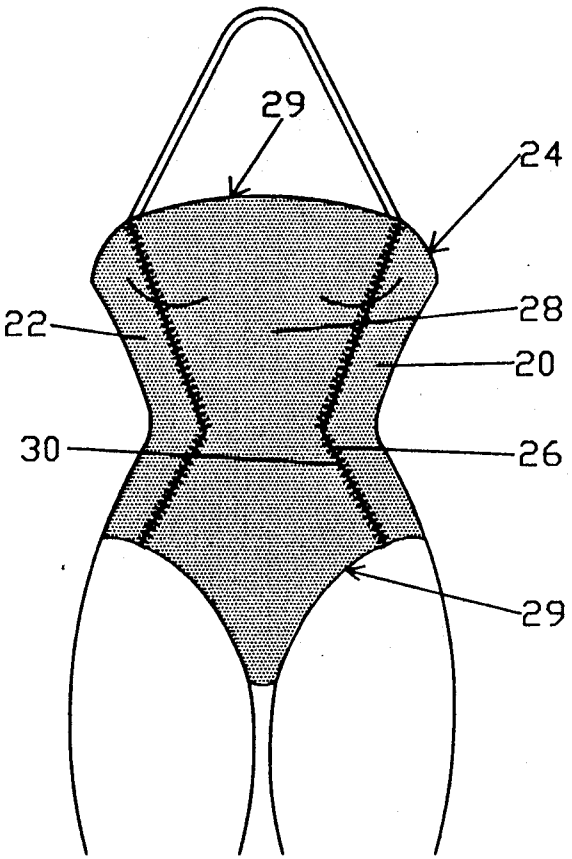
FIG. 6 is a front perspective view of the embodiment of FIG. 4, showing, however, the substituted use of a different central portion thereto.

The inventive garment system also includes a second central portion 28 (see FIGS. 3 and 6) which may be co-extensive in shape and perimeter with said first central portion 10, in which, in addition, is provided with perimetric cooperative fastening elements 30 which fastening elements are structurally identical to said first cooperative fastening elements 18 of first central portion 10. In other words, said second central portion 28, having a perimeter 29, may be structurally and geometrically identical to said first central portion 10, differing only in the ornamental, graphic or artistic material placed upon the fabric thereof. Thereby, it may be appreciated that said second central portion 28 may be selectably interchanged with said first portion to thereby effect a different appearance of the garment resultant from the inventive garment system.

Alternatively, said second central portion may exhibit a neckline, backline or legline that differs from that of said first central portion.

It is to be further appreciated that the area of the crotch of the resulting garment may be opened through the use of said first and second cooperative fastening elements 18 or 30, and 26, respectively. This feature of the inventive garment system facilitates bodily functions without need to entirely remove a garment resulting from the inventive garment system.

Additionally, it is to be appreciated that said left and right portions 20 and 22 respectively may be interchanged with other left and right portions having a differing ornamental definition.

Also, more elaborate means for facilitating opening of the crotch area, along the lines taught by said reference U.S. Pat. No. 4,675,918 to O'Brien, may be integrated into the present garment system.

As may be appreciated by comparison of the embodiment of FIG. 1 with the embodiment of FIG. 4, it is not necessary that all of the perimeters of a particular portion of the garment system be provided with cooperative fastening means. As may be noted in the embodiment of FIG. 1, only a portion on the perimeter need be provided with cooperative fastening means in an embodiment of the type shown therein.

Figure 8:
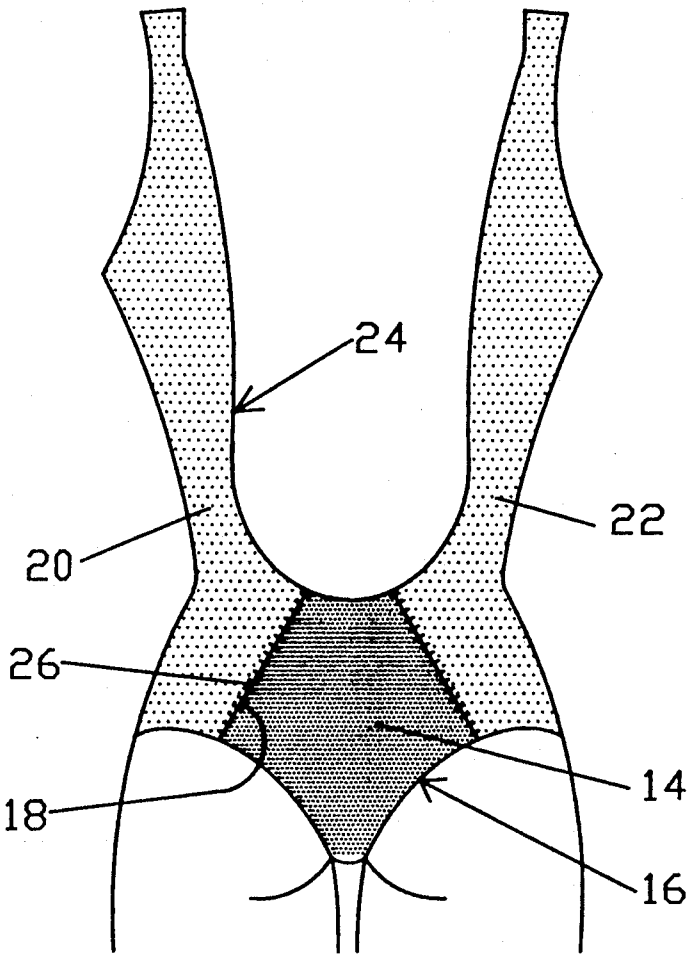
FIG. 8 is a rear perspective view of the embodiment of FIG. 7.
Figure 7:
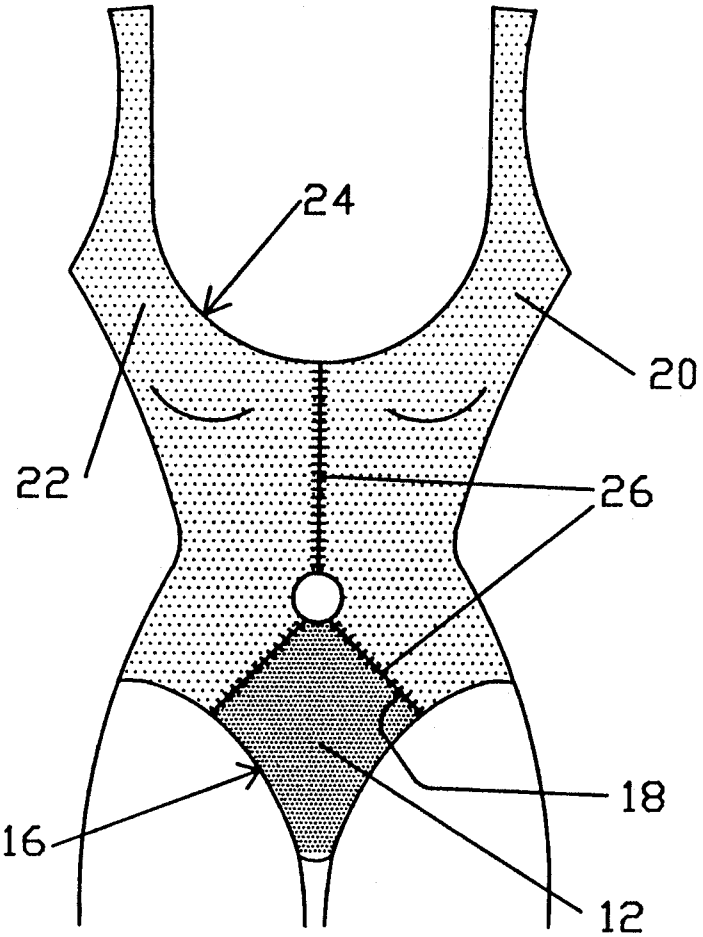
FIG. 7 is a front perspective view of a third embodiment of the present invention.
Figure 9:
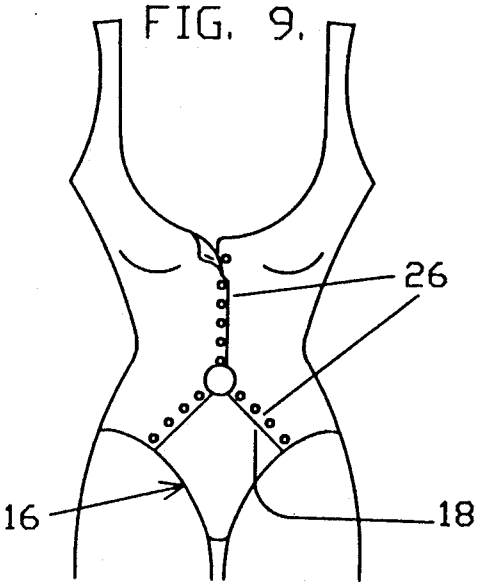
FIG. 9 is an enlarged view showing the use of button means as the cooperative fastening elements of the perimeters of the panels of the invention.
Figure 10:
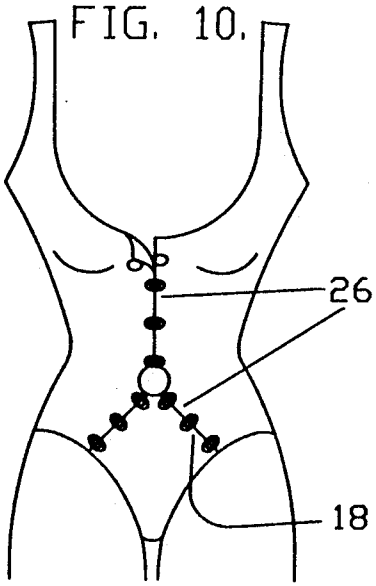
FIG. 10 is an enlarged view showing the use of D-buckles as the cooperative fastening elements of the invention.
Figure 11:
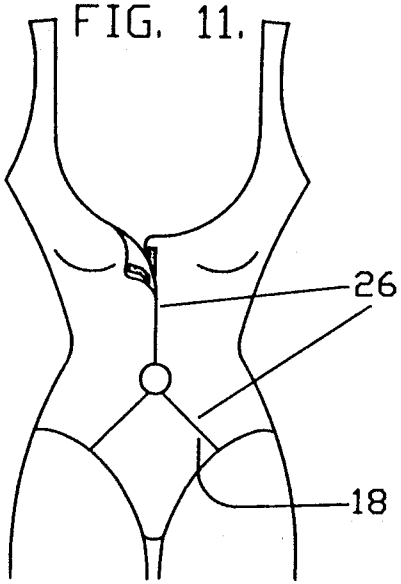
FIG. 11 is a perspective view showing the use of hook-and-pile means as the cooperative fastening elements.
Figure 12:
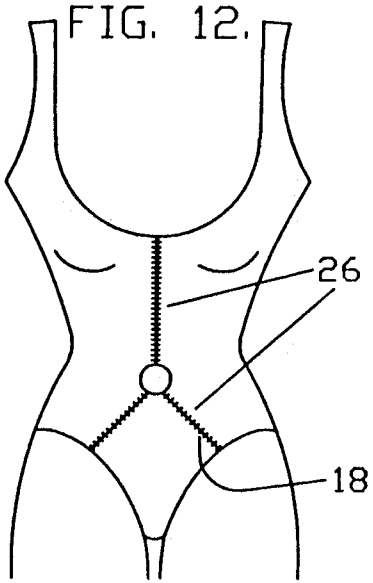
FIG. 12 is a perspective view showing the use of zippers as the cooperative fastening elements.

There is shown in FIGS. 7 and 8 a yet further embodiment of the instant invention.

Further the fabric of the panels of the garment system may be provided with selected anatomical contour support means.

Shown in FIGS. 9 through 12 are views illustrating the respective use of buttons, buckles, velcro and zippers in conjunction with the present invention.

Figure 14:
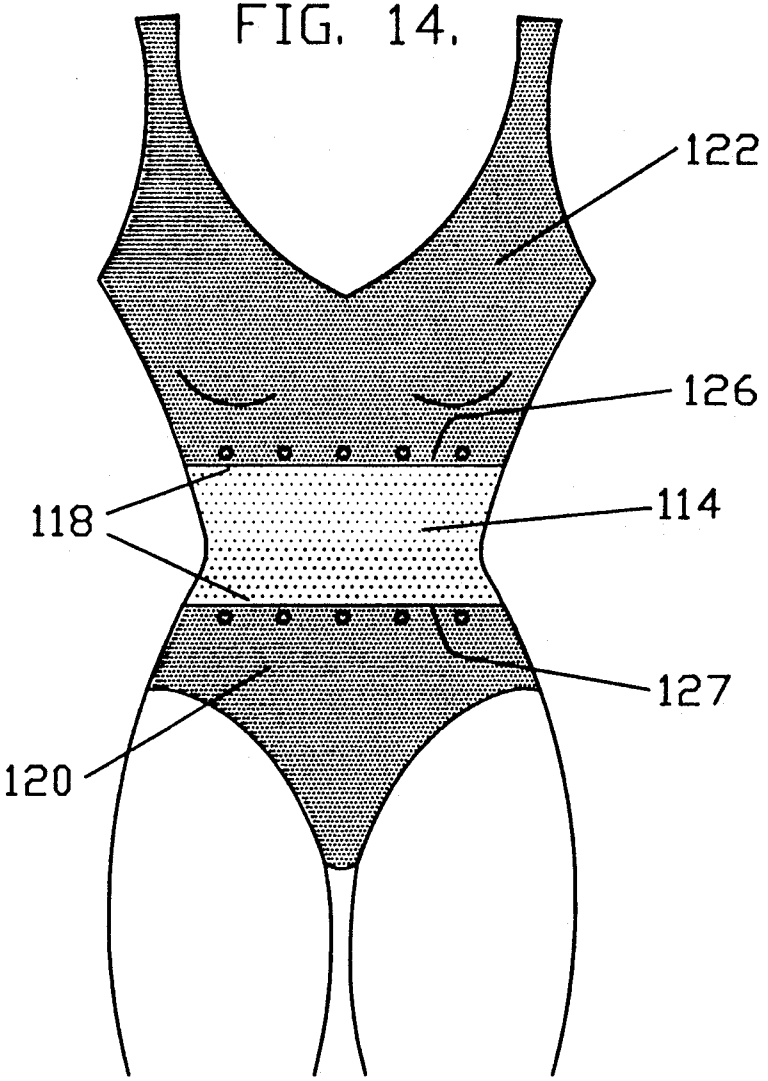
FIG. 14 is a front perspective view of the embodiment of FIG. 13, shown in bare midriff.
Figure 13:
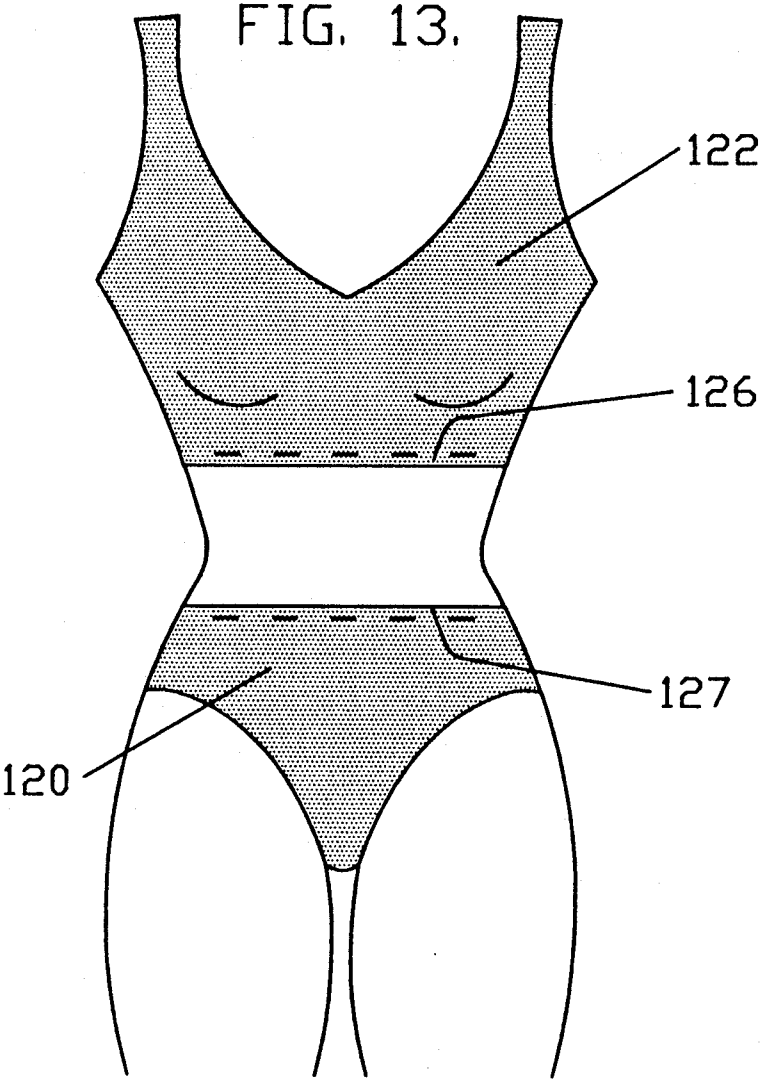
FIG. 13 is a front perspective view of a further embodiment of the invention.

Shown in FIGS. 13 and 14 is a further embodiment illustrating a selectably covered or bare midriff.

Accordingly, while there has been shown and described the preferred embodiments of the present invention, it is to be appreciated that the invention may be embodied otherwise than is herein specifically illustrated and described and that, within the scope of such embodiments, certain changes may be made within the detail and construction of the parts without departing from the underlying idea or principles of this invention within the scope of the appended claims.

Having thus described my invention, what I claim as new, useful and non-obvious and, accordingly, secure by Letters Patent of the United States is:

1. A bodywear system for the full or partial enclosure of the torso, comprising:

(a) a first central portion comprising a first ornamental region, said central portion further comprising a front and rear body panel, said front and rear panels having an integral common region comprising crotch enveloping means, each of said panels defined by lateral perimeters, said perimeters including first cooperative fastening elements, said perimeters defining the geometry of said first ornamental region;

(b) left and right portions encircling at least a part of the left and right sides of the torso respectively, said left and right portions comprising respective second and third ornamental regions, said left and right portions defined by lateral perimeters, said perimeters including second cooperative fastening elements complemental to said first cooperative fastening elements of said central portion, said lateral perimeters of each of said left and right portions defining the geometry of respective second and third ornamental regions, said left and right portions being releasably attachable to each other; and (c) a second central portion comprising front and rear panels having an integral common region comprising crotch enveloping means, said second central portion having like perimetric cooperative fastening elements co-extensive in shape and length to those of said first central portion, said second central portion comprising a fourth ornamental region selectably interchangeable with said first ornamental region of said first central portion to, thereby, effect a different appearance of a garment resultant from said bodywear system, whereby said area of the crotch of said central portion may be selectably released through the use of said complemental first and second cooperative fastening elements at said lateral perimeters thereof, thereby facilitating bodily functions without the need to entirely remove the garment resulting from the bodywear system.

2. The bodywear system as recited in claim 1 in which a segment of said lateral perimeters of said first central, second central, left, and right portions may be selectably attached and detached from each other.

3. The bodywear system as recited in claim 1 in which said first and second cooperative fastening elements comprise eye-and-button means.

4. The bodywear system as recited in claim 1 in which said first and second cooperative fastening elements comprise hook and buckle means.

5. The bodywear system as recited in claim 1 in which said first and second cooperative fastening elements comprise hook-and-pile means.

6. The bodywear system as recited in claim 1 in which said first and second cooperative fastening elements comprise anatomical contour support means.

7. A bodywear system for the full or partial enclosure of the torso, comprising:

(a) a central portion comprising a first ornamental region, said central portion having an integral common region comprising crotch enveloping means, each of said panels defined by lateral perimeters, said perimeters including first cooperative fastening elements, said lateral perimeters defining the geometry of said first ornamental region;

(b) first left and first right portions encircling at least a part of the left and right sides of t torso respectively, said left and right portions comprising respective second and third ornamental regions which are defined by said lateral perimeters, said perimeters including second cooperative fastening elements complemental to said first cooperative fastening elements of said central portion, said lateral perimeters of each of said left and right portions defining the geometry of respective second and third ornamental regions; and (c) second left and right portions encircling at least part of the left and right sides of the torso respectively, said second left and right portions comprising respective fourth and fifth ornamental regions, said ornamental regions defined by lateral perimeters thereof, said perimeters including like perimetric cooperative fastening elements to said second cooperative fastening elements and, thereby, which are complemental to said first cooperative fastening elements of said central portion, said lateral perimeter of each of said second left and second right portions defining the geometry of the respective fourth and fifth ornamental regions, whereby said second left and second right portions may be selectably interchanged with either or both of said first left and first right portions to thereby effect differing appearances in a garment resulting from the bodywear system, whereby said area of the crotch of said central portion may be selectably released through the use of said complemental first and second fastening elements at said lateral perimeters thereof, thereby facilitating bodily functions without the need to entirely remove the garment resulting from the bodywear system.

8. The bodywear system as recited in claim 7 in which a segment of said lateral perimeters of said central, first left, second left, first right, and second right portions may be affixed to each other to define the inventive bodywear system.

9. The bodywear system as recited in claim 7 in which said first and second cooperative fastening elements comprise eye-and-button means.

10. The bodywear system as recited in claim 7 in which said first and second cooperative fastening elements comprise hook-and-buckle means.

11. The bodywear garment system as recited in claim 7 in which said first and second cooperative fastening elements comprise hook-and-pile closure means.

* * * * *